US005497573A

United States Patent [19]

Stadjuhar et al.

[11] Patent Number: 5,497,573

[45] Date of Patent: Mar. 12, 1996

[54] THERMALLY-PROTECTED DISPLAY WITH A VENTILATION SYSTEM

[76] Inventors: Robert C. Stadjuhar, 1210 LaPaloma Way, Colorado Springs, Colo. 80906; Cecil S. Renfro, 3607 Brentwood Terrace, Colorado Springs, Colo. 80910

[21] Appl. No.: 224,201

[22] Filed: Apr. 14, 1994

[51] Int. Cl.[6] ..... G09F 13/04

[52] U.S. Cl. ..... 40/564; 40/573; 362/294; 362/373

[58] Field of Search ..... 40/564, 573, 574, 40/575, 577, 580; 362/294, 373

[56] References Cited

U.S. PATENT DOCUMENTS

| | | | |
|---|---|---|---|
| 3,659,366 | 5/1972 | Woolfolk | 40/447 |
| 4,006,546 | 2/1977 | Anderson et al. | 40/573 |
| 4,048,739 | 9/1977 | Benton, Jr. | 40/579 X |
| 4,271,408 | 6/1981 | Teshima et al. | 40/564 X |
| 4,739,568 | 4/1988 | Gearhart | 40/564 X |

*Primary Examiner*—Peter M. Cuomo

*Assistant Examiner*—James O. Hansen

*Attorney, Agent, or Firm*—Timothy J. Martin

[57] ABSTRACT

A thermally-protected display includes at least one display panel, a cover panel, a manifold and a blower mechanism. The display panel has a front panel surface and a rear panel surface and supports at least one signal element on the front panel surface. The cover panel is disposed in a spaced-apart relationship forwardly of the front panel surface to form a plenum chamber therebetween. The manifold is in fluid communication with the plenum chamber. The blower mechanism is in fluid communication with the manifold and supplies an airflow to the plenum chamber. The airflow enters an air inlet disposed at one end of the display panel and into the plenum chamber so that the airflow moves across the display panel and the signal element between the front panel surface and the cover panel thereby anticipating heat therefrom before the airflow exits the plenum chamber through an exhaust outlet disposed at an opposite end of the display panel. The thermally-protected display may include a housing structure for mounting the manifold and the display panel to form an enclosed interior whereby the rear surface of the display panel faces the interior.

35 Claims, 10 Drawing Sheets

THERMALLY-PROTECTED DISPLAY WITH A VENTILATION SYSTEM

FIELD OF INVENTION

The present invention broadly relates to signs employing a display capable of conveying a variety of messages. More particularly, the present invention is directed to a variable message sign having a display which is thermally-protected to inhibit heat transfer into its interior and ventilated to dissipate heat from its interior. The present invention is particularly suitable for variable message signs used on roadways to convey selected messages to motorists.

BACKGROUND OF THE INVENTION

For centuries, signs have been used to convey information such as commands, warnings and directions. Typically, earlier signs were letterboards posting the appropriate message. Once electricity became commercially viable, electric lighting was used to illuminate signs so that an observer could read the message at nighttime. Other signs were later developed which included electric lighting disposed within a light-transmissive sign housing to illuminate the sign both during daytime and nighttime hours for enhanced viewing of the message. Generally, these earlier signs conveyed one fixed message. With the advent of computers, signs have become more advanced in that variable messages could now be displayed on a single sign. Although there are many applications for variable message signs, one specific application is for highway use in order to convey messages to motorists. Usually, these messages warn motorists of forthcoming road conditions. Since road conditions can vary within brief periods of time, messages displayed on variable message signs must be changed accordingly so that motorists can have the latest and most accurate information of the road conditions lying ahead.

To effectively convey messages to motorists, the size of the message itself and positioning of the variable message sign are important considerations. In order to give a motorist adequate time to see and read the message, the letters on the sign must be sufficiently large. Typically, the alphanumeric characters of the message are eighteen (18) inches tall to provide sufficient legibility at a distance of at least eight hundred (800) feet from the variable message sign. Usually, the variable message sign is positioned either on a shoulder of the roadway or mounted onto a truss expanding above and across the roadway.

Coupled with a computerized controller, a display causes a desired message to appear on the variable message sign. The display comprises an array of signal elements that respond to commands from the computerized controller. Each of the signal elements in the array is typically either an electromechanical element or a light-emitting element. For example, one electromechanical element includes shutters and flip disks which alternate between a darkened state and a brilliant state to form the commanded characters in the message. The light emitting elements include ordinary light bulbs and light emitting diodes (commonly referred to as "LED's") which alternate between a light-on state and a light-off state to form the commanded characters in the message.

Particularly for roadway use, the display is usually enclosed in a sign housing to protect the signal elements and other working components of the variable message sign from adverse environmental conditions such as blowing dust and rain. In contrast, warm, sunny days can be detrimental to the operability of the variable message sign because radiant energy from inferred, ultraviolet and visible wavelength of sunlight is absorbed by the display and sign housing thus, generating heat. Heat can be detrimental to the signal elements and the other working components of the variable message sign. Absorption of radiant energy by the display and sign housing generates heat within the interior of the variable message display. Furthermore, operating electromechanical and light-emitting signal elements also generates heat within the interior. Temperatures within the interior during warm, sunny days can reach 160° Fahrenheit and above. Such extreme temperatures causes degradation of the operability of the signal elements resulting in expensive repairs or pre-mature replacement.

Repairs and replacement of components used with variable message signs can be problematic. For example, one type of a variable message sign employs clusters of diodes encapsulated in a plastic visor tube which typically shields the diodes from direct ultraviolet sunlight but not scattered ultraviolet sunlight. The visor tube snaps into and out of an array board extending across the face of the variable message sign. If, for any reason, the cluster of diodes within the visor tubes becomes inoperable, a repairman might be required to be suspended from above the variable message sign to gain access to the inoperable cluster of diodes. Although exchanging the visor tube is simple, gaining access to the inoperable one can be difficult and dangerous in that the repairman could be suspended over a busy highway. Additionally, ultraviolet sunlight causes degradation of the plastic visor tube which could break under sever weather conditions. If broken, the visor tube may not be able to shield the diodes from direct ultraviolet sunlight which, in turn, accelerates degradation of the diodes.

A need therefore exists to provide improved variable message signs, for example, which can shield radiant energy produced by sunlight to reduce heat generation into the interior thereof. A need also exists to provide variable message signs which are better ventilated to exhaust heat from the interior of the sign housing. Another need is to provide variable message signs which are easier and safer to repair and maintain. The present invention addresses these needs and these advantages.

SUMMARY OF INVENTION

It is an object of the present invention to provide a display for a variable message sign which is thermally-protected so that heat transfer into the interior of the sign housing can be minimized.

It is a further object of the present invention to provide a display for a variable message sign in which an air flow moves across the signal elements of the display to dissipate heat therefrom.

It is another object of the present invention to provide a variable message sign in which the interior of the sign housing can be ventilated to dissipate heat therefrom.

Yet another object of the present invention is to provide a display whereby a manifold not only supplies an airflow to the display but is also employed as a frame for mounting the display to the sign housing.

Yet another object of the present invention is to provide a display having fascia panels which shield radiant energy of the sun sunlight to minimize heat transfer into the interior of the variable message sign.

A further object of the present invention is to provide a display whereby fascia panels cover the manifold with minimal contact therebetween in order to minimize thermal conductivity.

A further object of the present invention is to provide a display which is protected against intrusion of air, water and airborne particles.

Yet another object of the present invention is to provide a display including a cover panel structure having a masking element with an outer masking surface which shields sunlight thus inhibiting heat transfer into the variable message sign and reducing degradation of the display diodes.

A still further object of the present invention is to provide a display that includes a cover panel structure having a light-transmissive panel which shields ultraviolet sunlight thus inhibiting heat transfer into the interior of the variable message sign.

A still further object of the present invention is to provide a variable message sign in which repair and maintenance of the display can be conducted within the interior of the sign housing, thus rendering repair and maintenance easier and safe.

Accordingly, a thermally-protected display with a ventilation system is hereinafter described. In its broadest form, the thermally-protected display includes a display panel, a cover panel, a manifold and a blower mechanism. The display panel has a front panel surface and a rear panel surface and supports at least one signal element on the front panel surface of the display panel. The cover panel is disposed in a spaced-apart relationship forwardly of the front panel surface of the display panel to form a plenum chamber therebetween. The manifold is in fluid communication with the plenum chamber. The blower mechanism is in fluid communication with the manifold and is operative to supply an airflow to the plenum chamber. The airflow enters an air inlet disposed at one end of the display panel and into the plenum chamber so that the airflow moves across the display panel and the signal element between the front panel surface and the cover panel to dissipate heat therefrom before the airflow exits the plenum chamber through an exhaust outlet disposed at an opposite end of the display panel.

Preferably, the manifold is operative to support the display panel and the cover panel laterally across and proximate to respective lower edge portions of the display panel and cover panel. The thermally-protected display can also include a pair of retainer elements. Each of the retainer elements is mounted to a respective one of the manifold and the structural member in an opposed facing relationship. The pair of retainer elements are operative to support the display panel and the cover panel to and between the manifold and the structural member.

The thermally-protected display here includes a structural member that is disposed above the manifold and that is operative to support the display panel and the cover panel laterally across and proximate to respective upper edge portions of the display panel and cover panel.

The thermally-protected display panel further preferably includes a pair of fascia panels. A respective one of the fascia panels is associated with the manifold and the structural member forwardly of the cover panel. A respective one of the pair of fascia panels extends over opposite lateral margin portions of the cover panel. Each of the fascia panels includes an outer fascia surface having an ultraviolet protective coating which is operative to ultraviolet sunlight. It is preferred that the ultraviolet protective coating is a fluropolymer resin. A gasket element is disposed between each fascia panel and each lateral margin portion of the cover panel and is operative to form a seal between the fascia panels and the cover panels. A pair of spacing ridges extend from the manifold in a forward direction relative to the front panel surface. The pair of spacing ridges are operative to contact the fascia panel therealong so as to support the fascia panels away from the manifold in order to minimize thermal conductivity therebetween.

It is preferred that the thermally-protected display include a plurality of display panels and a plurality of cover panels. Each display panel is connected between a pair of vertically extending brackets. Each of the vertical brackets has opposite bracket ends adapted for insertion into the retainer elements so that the plurality of display panels can be supported therein to form a row of display panels. At least several of the plurality of display panels are associated with a common cover panel. A vertical spacer member extends rearwardly relative to the front panel surface and is disposed between adjacent vertical brackets to separate adjacent display panels from each other. It is preferred that the plurality of display panels are organized into a plurality of rows and columns. Each row of the display panels is associated with one manifold in a form of an air distributing section with each air distributing section being in fluid communication with one another by a balancing section.

It is preferred that a secondary duct is provided so that it can be in fluid communication with and between the manifold and the plenum chamber. The secondary duct is disposed rearwardly of the display panel and extends laterally thereacross proximate to the lower edge portion of the display panel. The secondary duct is operative to direct a portion of the airflow to the air inlet and a remaining portion of the airflow onto the rear panel surface of the display panel.

The thermally-protected display panel is shown to include a housing structure operative to mount the manifold and the display panel thereby to form an enclosure. The enclosure has an interior so that the rear surface of the display panel faces the interior. It is preferred that the blower mechanism is disposed within the interior of the enclosure so that the blower mechanism is operative to draw air exteriorly thereof. The enclosure includes an enclosure outlet which is operative so that the airflow exiting the plenum chamber from the exhaust outlet flows into the interior and subsequently through the enclosure outlet.

It is also preferred that the thermally-protected display include a display panel with an array of signal elements wherein each of the signal elements is a cluster of light-emitting diodes and a cover panel with a masking element. The masking element has a plurality of windows which are sized and arranged to correspond with the array of signal elements. The masking element includes an outer masking surface facing forwardly with respect to the front panel surface of the display panel and is operative to thermally insulate the cover panel. It is preferred that the outer masking surface is an ultraviolet protective coating such as a fluropolymer resin to shield ultraviolet sunlight.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention is directed to a thermally-protected display with a ventilation system. The description of the exemplary embodiments of the present invention relates to two types of thermally protected displays. One type of thermally-protected display is suitable for mounting onto a support structure such as a wall. Often, these types of displays are seen in restaurants and taverns to inform patrons of developing events such as sports scores and snippets of daily news. The other type of a thermally-protected display with a ventilation system is mounted onto a truss extending across a roadway to inform motorists of forthcoming road conditions. One of ordinary skill in the art would appreciate that there is a variety of applications for the present invention in addition to those described herein. For example, another type of thermally-protected display would be a trailer-mounted display for highway use and another would be a revolving display showing the present time and temperature.

Figure 1:
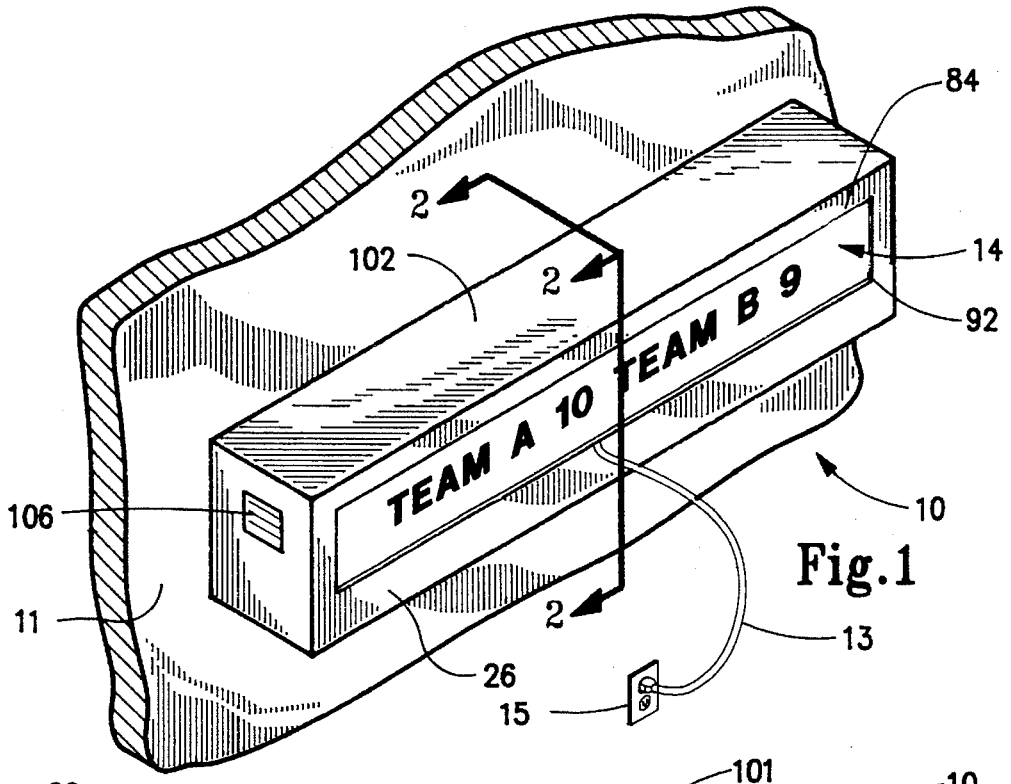
FIG. 1 is a perspective view of a first exemplar/embodiment of a thermally-protected display with a ventilation system according to the present invention mounted to a support structure such as a wall.
Figure 2:
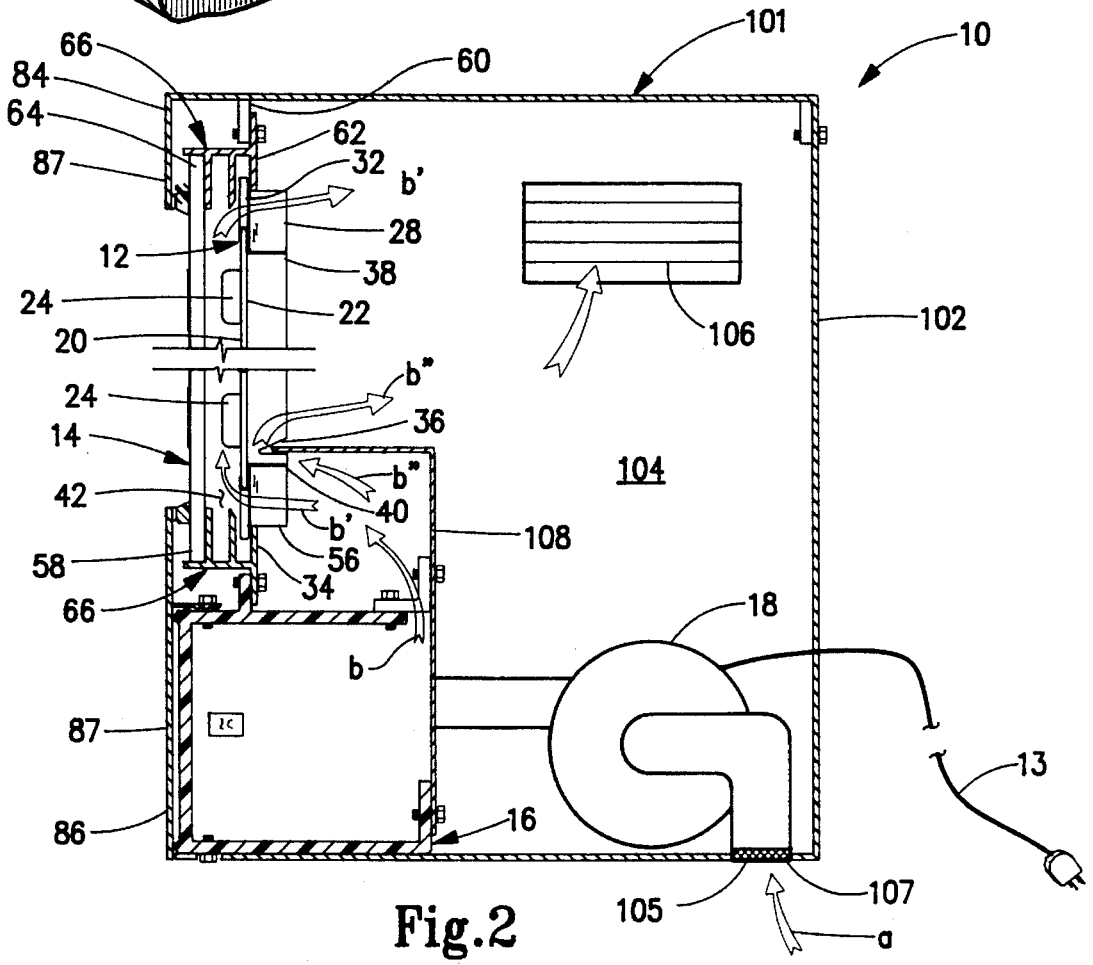
FIG. 2 is a cross-sectional view taken along lines 2—2 of the thermally-protected display with a ventilation system shown in FIG. 1.
Figure 3:
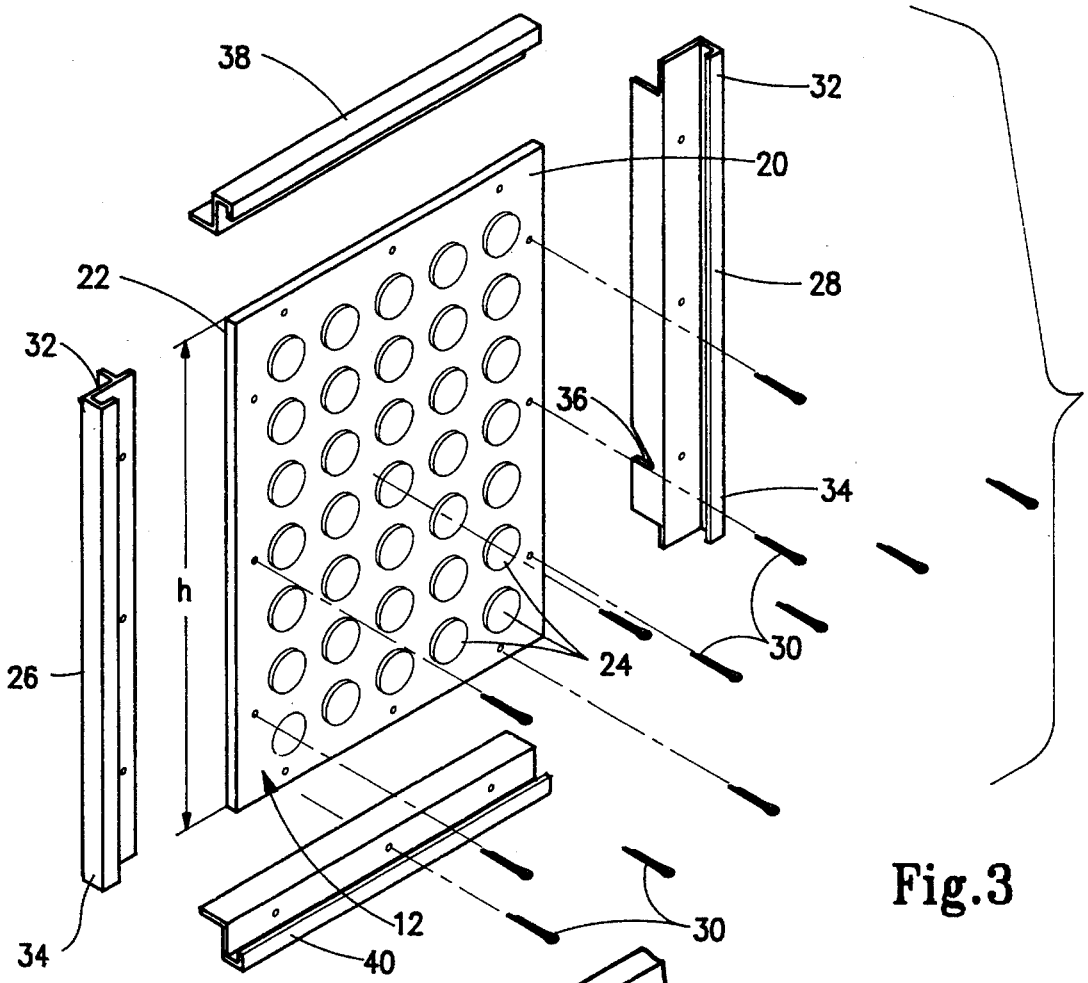
FIG. 3 is an exploded perspective view of a display panel having an array of signal elements and a pair of vertical brackets and a pair of horizontal brackets adapted to be connected thereto.

A thermally-protected display 10 is generally introduced in FIGS. 1–6. Thermally-protected display 10 mounted to a support structure 11 such as a wall includes a display panel 12, a cover panel structure 14, a manifold 16 and a blower mechanism 18. Power is supplied to thermally-protected display 10 by a conventional electric cable 13 plugged into a conventional electric wall socket 15. As best shown in FIGS. 2 and 3, display panel 12 has a front panel surface 20 and a rear panel surface 22. Display panel 12 supports at least one signal element 24 on front panel surface 20 thereof although an array of signal elements 24, as shown, is preferred. Signal elements 24 can be either electromechanical elements such as shutters and flip disks or light-emitting elements such as ordinary light bulbs or light emitting diodes. For the first exemplary embodiment of the present invention, it is preferred that display panel 12 is a circuit board and each signal element 24 of the array is a cluster of 18 to 24 light-emitting diodes directly mounted to the circuit board although the cluster could include a plurality of 2 to 60 light emitting diodes. Each cluster of light-emitting is considered to be one pixel. One of ordinary skill in the art would appreciate that display panel 12 includes an array of signal elements 24 which could be arranged in any select number of columns and rows. However, for representative purposes only, display panel 12 as illustrated in FIG. 3 has been chosen. Display panel 12 has a height "h" of approximately 20 inches with five (5) columns and seven (7) rows of signal elements 24. Display panel 12 is connected between a pair of vertically extending brackets 26 and 28 by conventional cotter pins 30. Each bracket 26 and 28 has opposite bracket ends 32 and 34 and a notch 36 disposed at a lower end thereof. Display panel 12 is also mounted between a pair of horizontal brackets 38 and 40 by conventional cotter pins 30.

Figure 4:
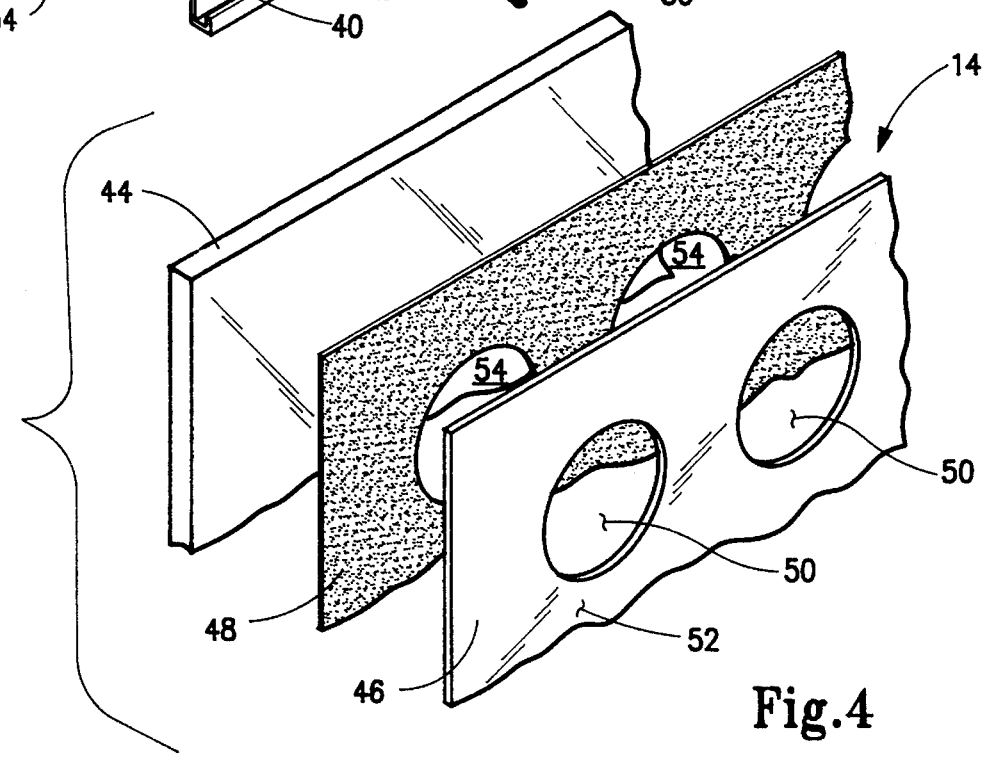
FIG. 4 is a an exploded perspective view of a corner portion of a cover panel structure of the present invention showing a light-transmissive plate approximately 90% opaque to ultraviolet sunlight, a sheet of an elastomeric adhesive material and a masking element with windows.

In FIG. 2, cover panel structure 14 is disposed in a spaced-apart relationship forwardly of front panel surface 20 of display panel 12 to form a plenum chamber 42. With reference to FIG. 4, cover panel structure 14 includes a light-transmissive panel 44 and a masking element 46 laminated to each other by a sheet of elastomeric adhesive material 48. Light-transmissive panel 44 is a polycarbonate glazing material which is approximately 90% opaque to ultraviolet rays of sunlight. Masking element 46 has a plurality of windows 50 sized and arranged to correspond with the array of signal elements 24 so that the array of signal elements 24 may be viewed through a respective window 50. Masking element 46 includes an outer masking surface 52 which faces forwardly with respect to front panel surface 20 of display panel 12 and is operative to thermally insulate cover panel structure 14. It is preferred that outer masking surface 52 is an ultraviolet protective coating of fluropolymer resin which is operative to shield ultraviolet sunlight. It is further preferred that this coating is a black Kynar®500 fluropolymer resin coating. Kynar® is a registered trademark of Atochem North America, Inc., formerly known as Pennwalt Corporation, located in Philadelphia, Pa. In addition to reducing solar gain which contributes to heat generation, this black coating also provides color contrast when signal elements 24 are activated into a brilliant state and does not gray-out from sunlight over time. The sheet of elastomeric adhesive material 48 includes holes 54 which correspond to windows 50 of masking element 46 so that, when signal elements 24 are in a brilliant state, they can be seen therethrough. The sheet of elastomeric material 48 also provides a seal surrounding windows 50 of masking element 46 and between masking element 46 and light-transmissive panel 44. Therefore, in lieu of the sheet of elastomeric adhesive material 48, either strips or small patches of the same can be used to seal around windows 50 to prevent rain, dust and the like from entering between masking element 46 and coat-transmissive panel 44. Additionally, the sheet of elastomeric adhesive material 48 allows thermal expansion between light-transmissive panel 44 and masking element 46. Furthermore, one of ordinary skill in the art would appreciate that, in lieu of cover panel structure 14, a cover panel of light-transmissive material can be employed without departing from the spirit of the present invention.

Figure 5:
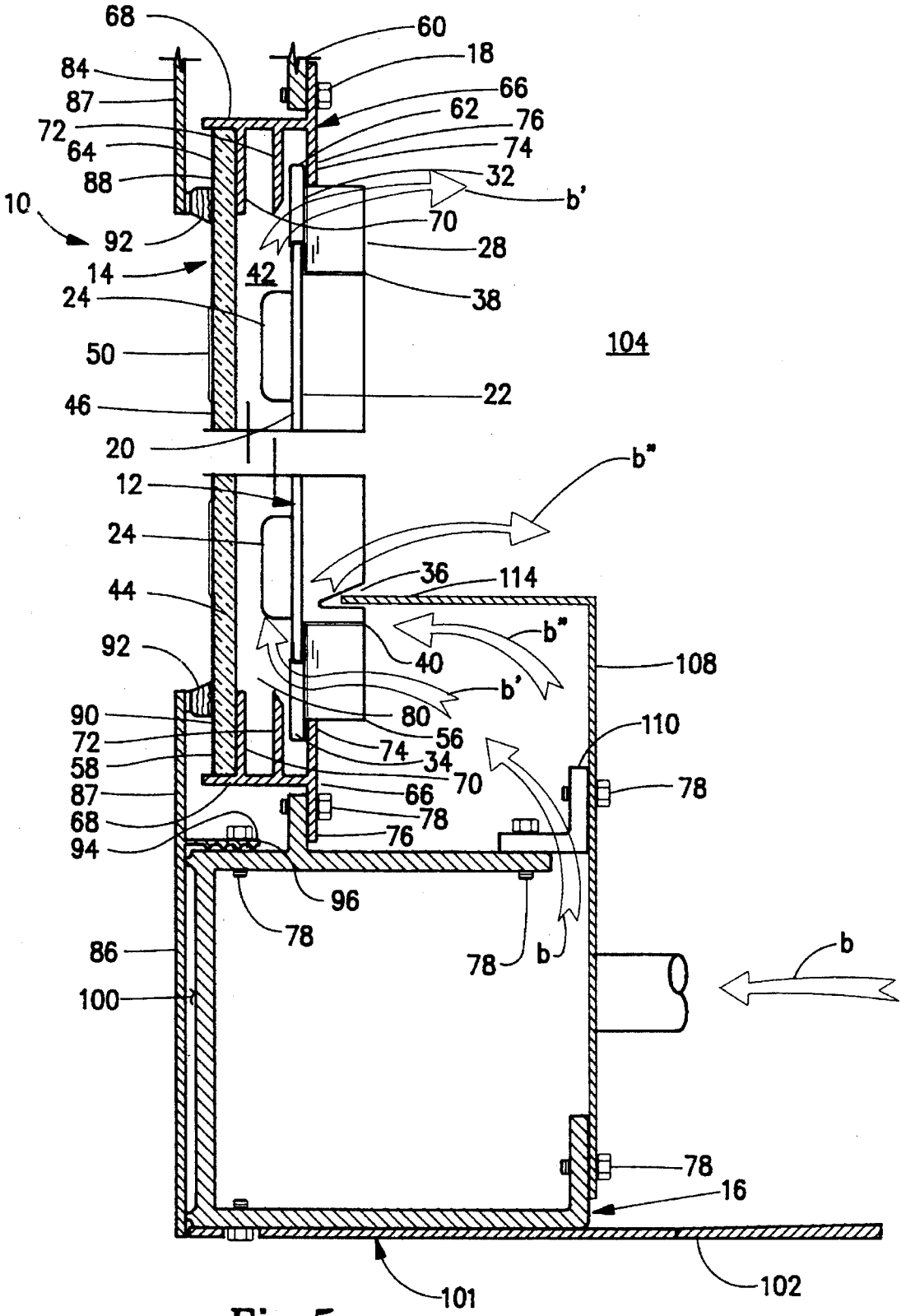
FIG. 5 is an enlarged partial view in cross-section of the present invention in FIG. 1 showing an airflow from a manifold moving through a plenum chamber formed between the cover panel structure and the display panel.
Figure 6:
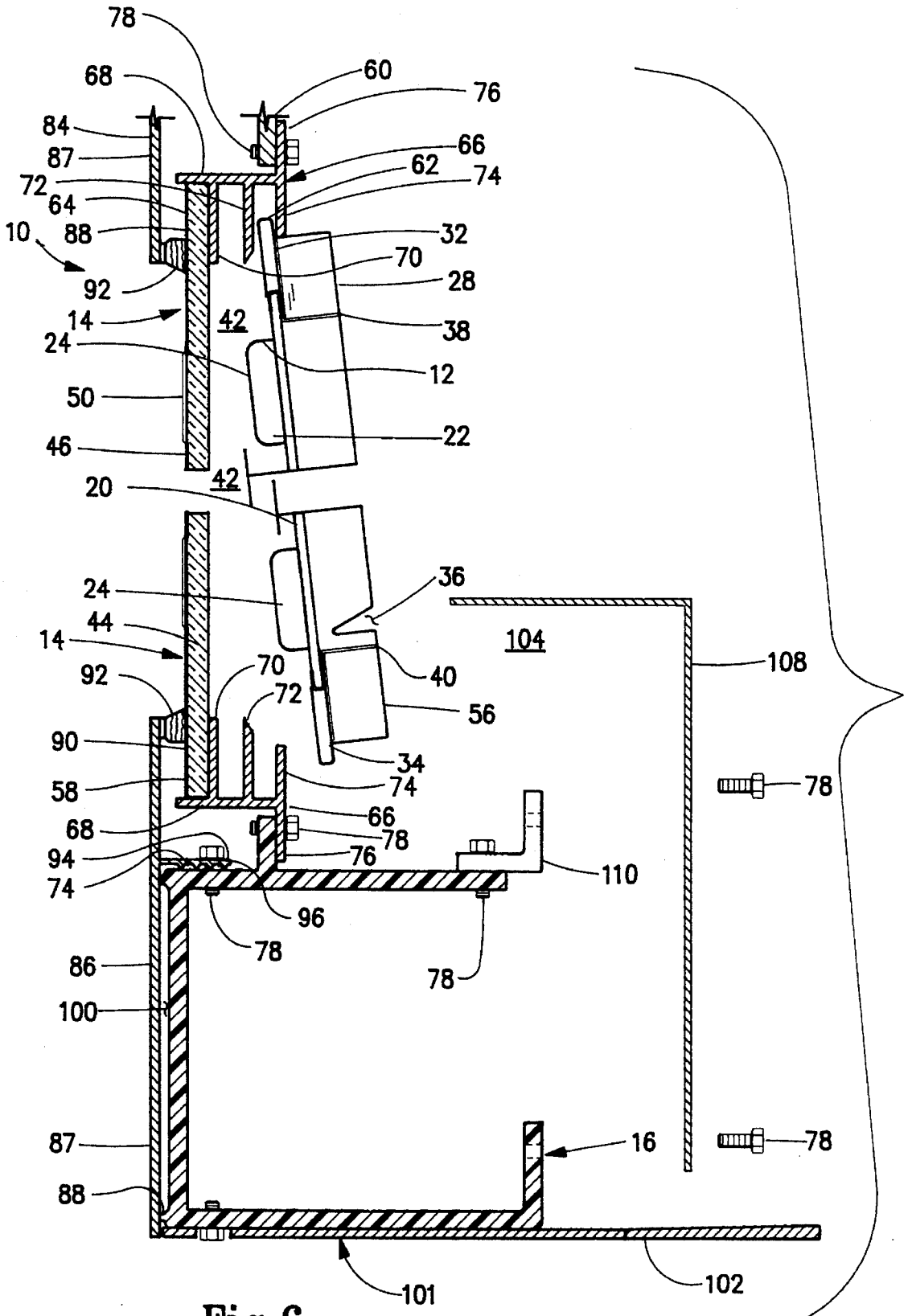
FIG. 6 is an enlarge side view partially exploded showing the removal of a secondary duct from the manifold and the partial removal of the display panel from a pair of facially opposing retainer elements.

As shown in FIGS. 2, 5 and 6, manifold 16 is in fluid communication with plenum chamber 42. Manifold 16 is operative to support display panel 12 and cover panel structure 14 laterally across and proximate to respective lower edge portions 56 and 58 of display panel 12 and cover panel structure 14. A structural member 60 is disposed above manifold 16 and is operative to support display panel 12 and cover panel structure 14 laterally across and proximate to respective upper edge portions 62 and 64 of display panel 12 and cover panel structure 14. Specifically, a pair of retainer elements 66 are employed to support display panel 12 and cover panel structure 14 to and between manifold 16 and structural member 60. Each retainer element 66 has a base wall member 68 with a forward wall member 70, an intermediate wall member 72 and a rear wall member 74 projecting perpendicularly therefrom in a spaced-apart parallel relationship. A supporting wall member 76 projects perpendicularly from base wall member 68 opposite of forward wall member 70, intermediate wall member 72 and rear wall member 74. Each of retainer elements 66 is mounted to a respective one of manifold 16 and structural member 60 in an opposed facing relationship by connecting supporting wall member 76 thereto with a fastener 78. With display panel 12 mounted between the pair of vertical brackets 26 and 28, an artisan would appreciate that vertical brackets 26 and 28 at bracket ends 32 and 34 are adapted for insertion into retainer elements 66 so that display panel 12 can be supported therein. As best shown in FIG. 5, bracket end 32 of vertical bracket 28 is disposed between intermediate wall member 72 and rear wall member 76 of retainer element 66 mounted to structural member 60. Bracket end 34 of vertical bracket 28 is disposed between intermediate wall member 72 and rear wall member 74 of retainer element 66 connected to manifold 16. Note that display panel 12 is supported by rear wall member 74 of retainer element 66 connected to manifold 16 with vertical bracket 28 resting thereon. An air inlet 80 is disposed at one end of display panel 12 and is formed between bracket ends 34 and between intermediate wall member 72 and horizontal bracket 40. An exhaust outlet 82 is disposed an opposite end of display panel 12 and is formed between bracket ends 32 and between intermediate wall member 72 and horizontal bracket 38.

Thermally-protected display 10 includes a pair of fascia panels 84 and 86 which are disposed forwardly of cover panel structure 14. Fascia panel 84 is associated with structural member 60 and fascia panel 86 is associate with manifold 16. Each fascia panel 84 and 86 is operative to thermally insulate structural member 60 and manifold 16 respectively. Each fascia panel 84 and 86 has an outer fascia surface 87 coated with an ultraviolet protective coating which is operative to shield ultraviolet sunlight and other radiant energy. The black Kynar®500 fluropolymer resin coating, discussed above, is preferred in order to reduce solar gain. A respective one of the pair of fascia panels 84 and 86 extends over opposite lateral margin portions 88 and 90 of cover panel structure 14. A gasket element 92 is disposed between each fascia panel 84 and 86 and a respective one of each lateral margin portion 88 and 90 of cover panel structure panel 14. Each gasket element 92 is operative to form a seal between respective fascia panels 84 and 86 and cover panel structure 14 to protect thermally-protected display 10 against intrusion of air, water and airborne particles. Fascia panel 86 includes a support wall 94 which extends perpendicularly from fascia panel 86 and extends rearwardly towards cover panel structure 14. Support wall 94 includes a serrated surface 96 to minimize surface to surface contact between manifold 16 and support wall 94 to minimize thermal conductivity therebetween. Fastener 78 connects support wall 94 to manifold 16.

A pair of spacing ridges 98 extend from manifold 16 in a forward direction relative to front panel surface 20. Spacing ridges 98 are operative to contact fascia panel 86 therealong so as to support fascia panel 86 away from manifold 16 to minimize surface to surface contact therebetween, and thus, minimizing thermal conductivity therebetween. A void space 100 is formed between spacing ridges 98 and between fascia panel 86 and manifold 16 to further insulate manifold 16 from heat transfer. As best shown in FIGS. 1, 2 and 5, a housing structure 101 is operative to mount manifold 16 and display panel 12 thereby forming an enclosure 102 having an interior 104 so that rear panel surface 22 faces interior 104. Blower mechanism 18 is disposed within interior 104 and is operative to draw air, shown by arrow "a" in FIG. 2, exteriorly of interior 104 from enclosure inlet 105 through enclosure inlet filter 107. Blower mechanism 18 is operative to supply an airflow, shown by arrow "b" to manifold 16 and to plenum chamber 42. A first portion of airflow "b'" enters air inlet 80 and into plenum chamber 42. Airflow "b'" moves across display panel 12 and at least one signal element 24 between front panel surface 20 and cover panel structure 14 thereby dissipating heat therefrom before airflow "b'" exits plenum chamber 42 through exhaust outlet 82. Enclosure 102 includes an enclosure outlet 106 which is operative so that airflow "b'" exiting plenum chamber 42 from exhaust outlet 82 flows into interior 104 and subsequently through enclosure outlet 106 thus ventilating thermally-protected display 10.

It is preferred that a secondary duct 108 is in fluid communication with and between manifold 16 and plenum chamber 42 as shown in FIGS. 5 and 6. Secondary duct 108 is disposed rearwardly of display panel 12 and extends laterally thereacross proximate to lower edge portion 56 of display panel 12. A lower vertical portion of secondary duct 108 is releasably and directly connected to manifold 16 by fastener 78 and a medial portion of secondary duct 108 is releasably and indirectly connected to manifold 16 by an angled piece 110 interconnecting manifold 16 and secondary duct 108 by fasteners 78. A horizontal portion of secondary duct 108 extends into notch 36 of respective vertical brackets 26 and 28 to form a secondary exhaust outlet 114 between vertical brackets 26 and 28 and the horizontal portion of secondary duct 108 extending into notch 36 and horizontal bracket 40. Thus, secondary duct 108 is operative to direct first portion "b'" of airflow "b" into air inlet 80 and a second portion of airflow "b"" onto rear panel surface 22 of display panel 12. Likewise, the second portion "b"38 of airflow "b" flows into interior 104 and subsequently through enclosure outlet 106.

One of ordinary skill in the art would appreciate that the thermally-protected display 10 can be disassembled within interior 104 of enclosure 102. With reference to FIG. 6, secondary duct 108 is disconnected from manifold 16 by unfastening fasteners 78. To remove display panel 12, a repair person simply lifts upwardly on display panel 12 to clear bracket ends 34 over front rear wall member 74 of retainer element 66 connected to manifold 16, pulls forwardly at lower edge portions 56 of display panel 12 and then lowers display panel 12 to clear bracket ends 32 from rear wall member 74 of retainer element 66 connected to support structure 60. Also, one of ordinary skill in the art would appreciate that retainer elements 66 can be removed within interior 104 of enclosure 102 by unfastening fastener elements 78 from manifold 16 and structural member 60. Now, cover panel structure 14 can also be removed into interior 104 of enclosure 102 for repair and maintenance.

A second exemplary embodiment of a thermally-protected display 210 with a ventilation system of the present invention is generally shown in FIGS. 7–10. The second exemplary embodiment of the present invention is mounted to a truss 211 expanding over a roadway 213 so that messages can be conveyed to motorists. The thermally-protected display 210 of the present invention includes a plurality of display panels 212, at least one cover panel structure 214, a manifold 216, housing structure 201 and a blower mechanism 218. The plurality of display panels 212 are arranged in a row $R_1$. Cover panel structure 214 is disposed in a space-apart relationship forwardly of front panel surfaces 220 of display panels 212 to form a plenum chamber 242 between cover panel structure 214 and each of display panels 212. Manifold 216 is in fluid communication with each of plenum chambers 242.

Figure 7:
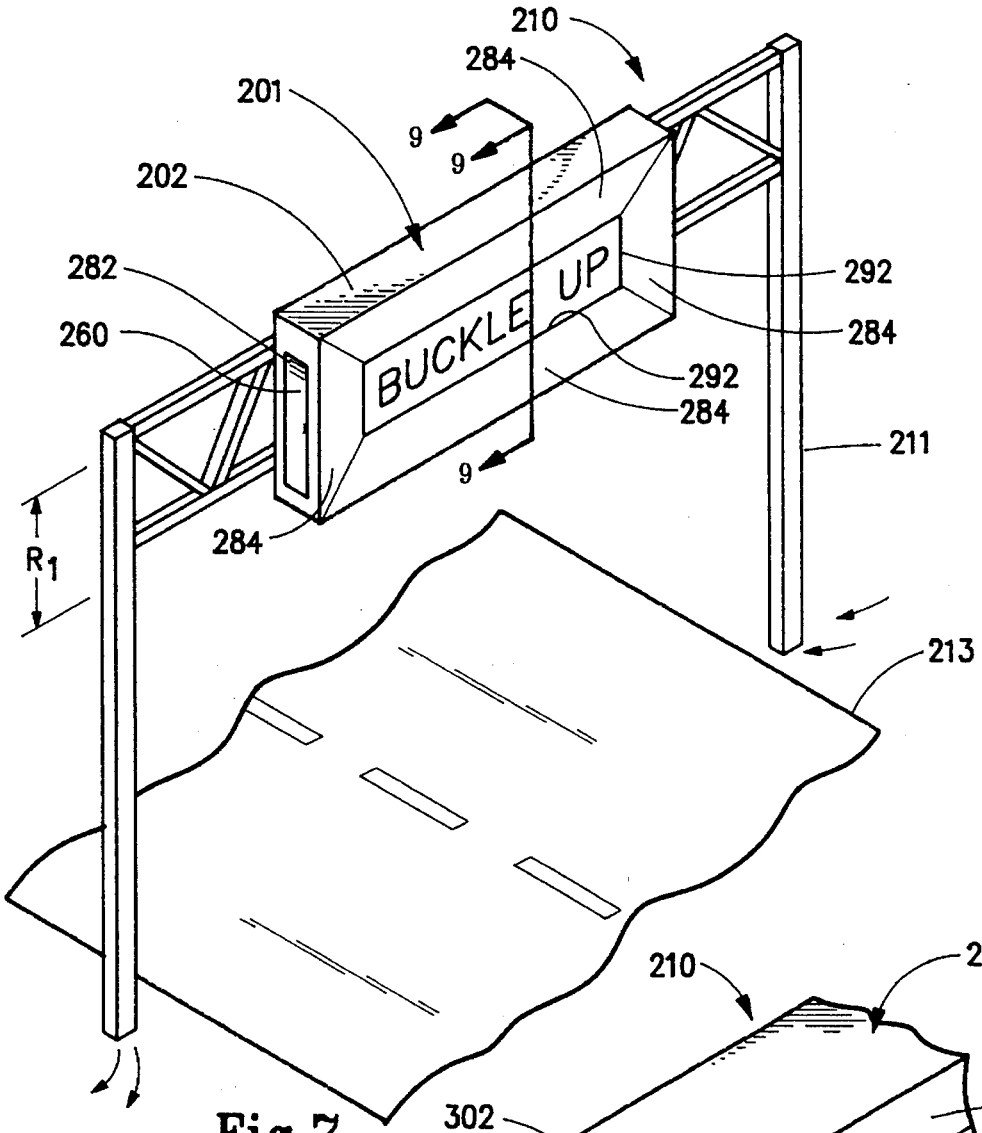
FIG. 7 is a perspective view of a second exemplary embodiment of the present invention shown mounted to a truss expanding a roadway.
Figure 8:
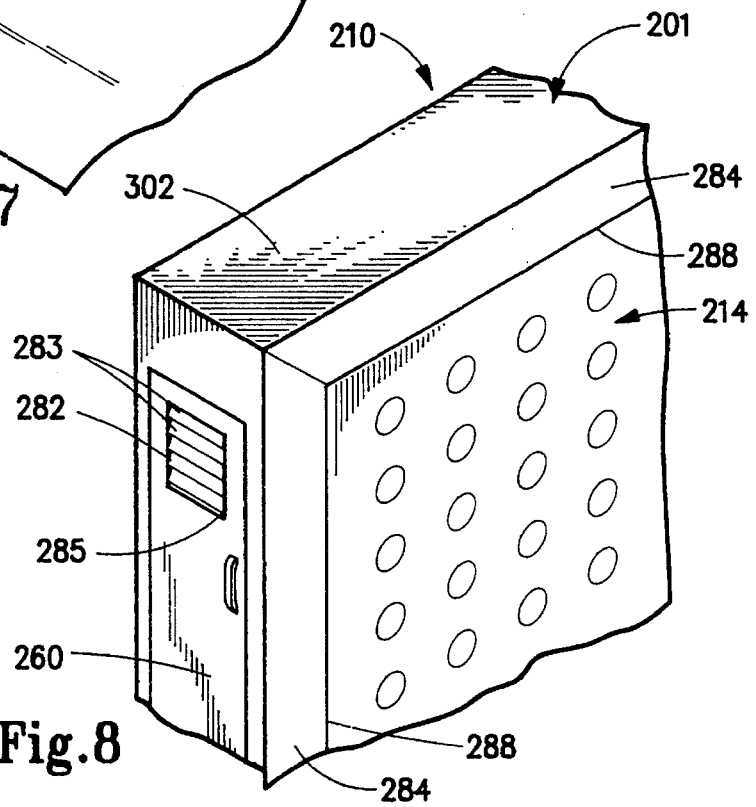
FIG. 8 is an enlarged partial perspective view of the second exemplary embodiment of the present invention shown in FIG. 7.
Figure 9:
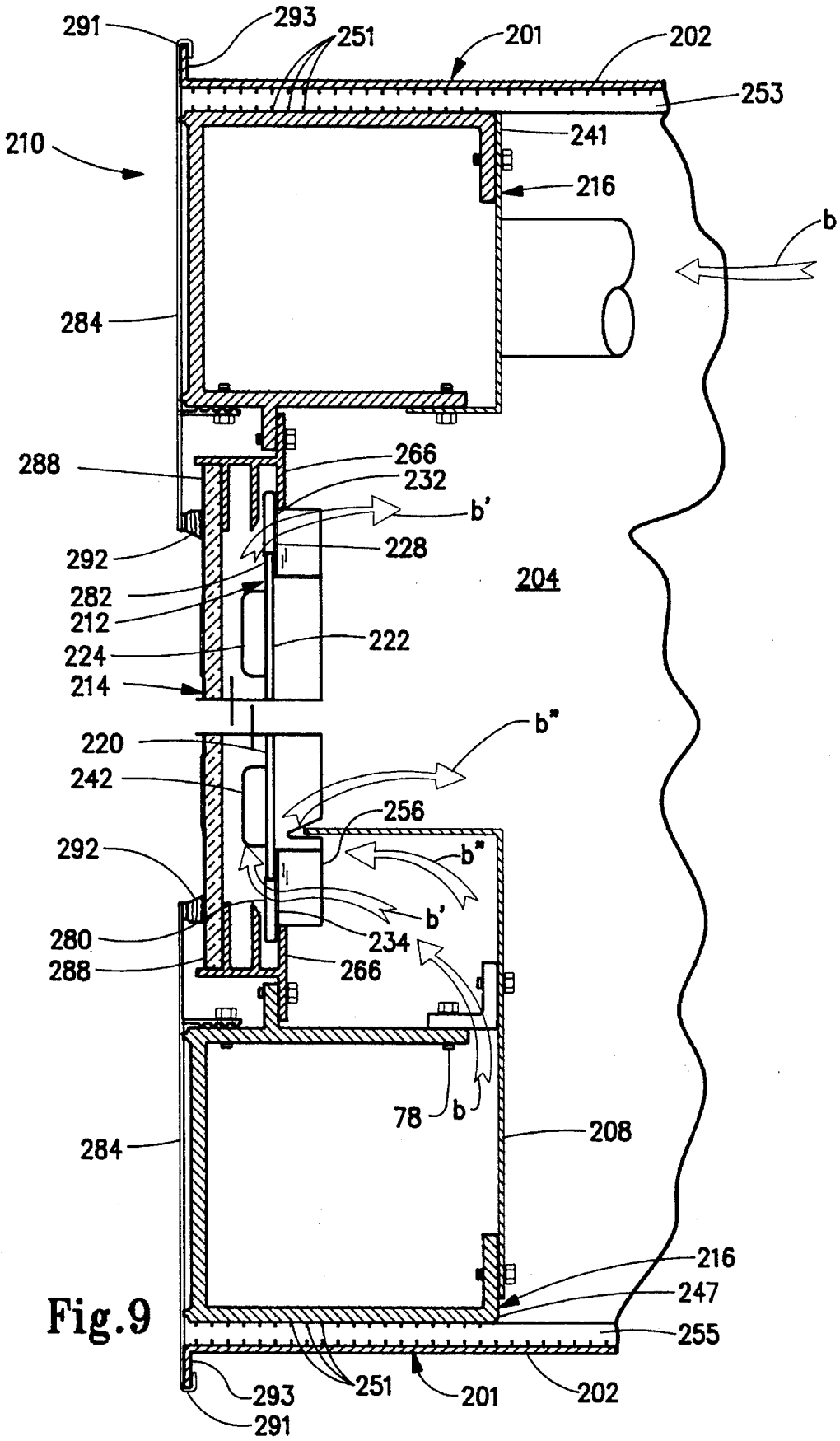
FIG. 9 is an enlarged, partial side view in elevation shown along lines 9—9 in FIG. 7 illustrating an airflow from a manifold through the plenum chamber formed between the cover panel structure and the display panel.

With reference to FIGS. 7, 8 and 9, housing structure 201 is operative to mount manifold 216 and display panels 212 thereby forming an enclosure 202 having an interior 204 so that rear panel surfaces 222 of display panels 212 face interior 204. Enclosure 202 is sized to allow access into interior 204 by a human being so that repair and maintenance can take place within enclosure 204. Access thereto is gained through a door 260. Door 260 includes an enclosure outlet 282. Motorized louvers 283 are operable between an opened state and a closed state as explained hereinbelow. Enclosure outlet 282 also includes an exhaust filter 285. Manifold 216 forms a frame surrounding row $R_1$ of display panels 212 and is operative to be secured to enclosure 202 as best shown in FIGS. 9. Although not by way of limitation, manifold 216 is secured to enclosure 202 by making stitch weldments 251 between ceiling joist 253 and air balancing section 249 and between an air distributing section 247 and floor joist 255. Manifold 216 includes at least one air distributing section 247 in fluid communication with row $R_1$ of display panels 212 and air balancing section 249 which is in fluid communication with air distributing section 247.

A pair of retainer elements 266 support row $R_1$ of display panels 212 and cover panel structure 214 to manifold 216. Specifically, each of retainer elements 266 is mounted to a respective one of air distributing section 247 and air balancing section 249 of manifold 216 in an opposed facing relationship as shown in FIG. 9. Thus, the pair of retainer elements 266 are operative to support the plurality display panels 212 and cover panel structure 214 to and between air distributing section 247 and air balancing section 249 of manifold 216. Retainer elements 266 are adapted to be removable into interior 204 of enclosure 202, as discussed above.

Figure 10:
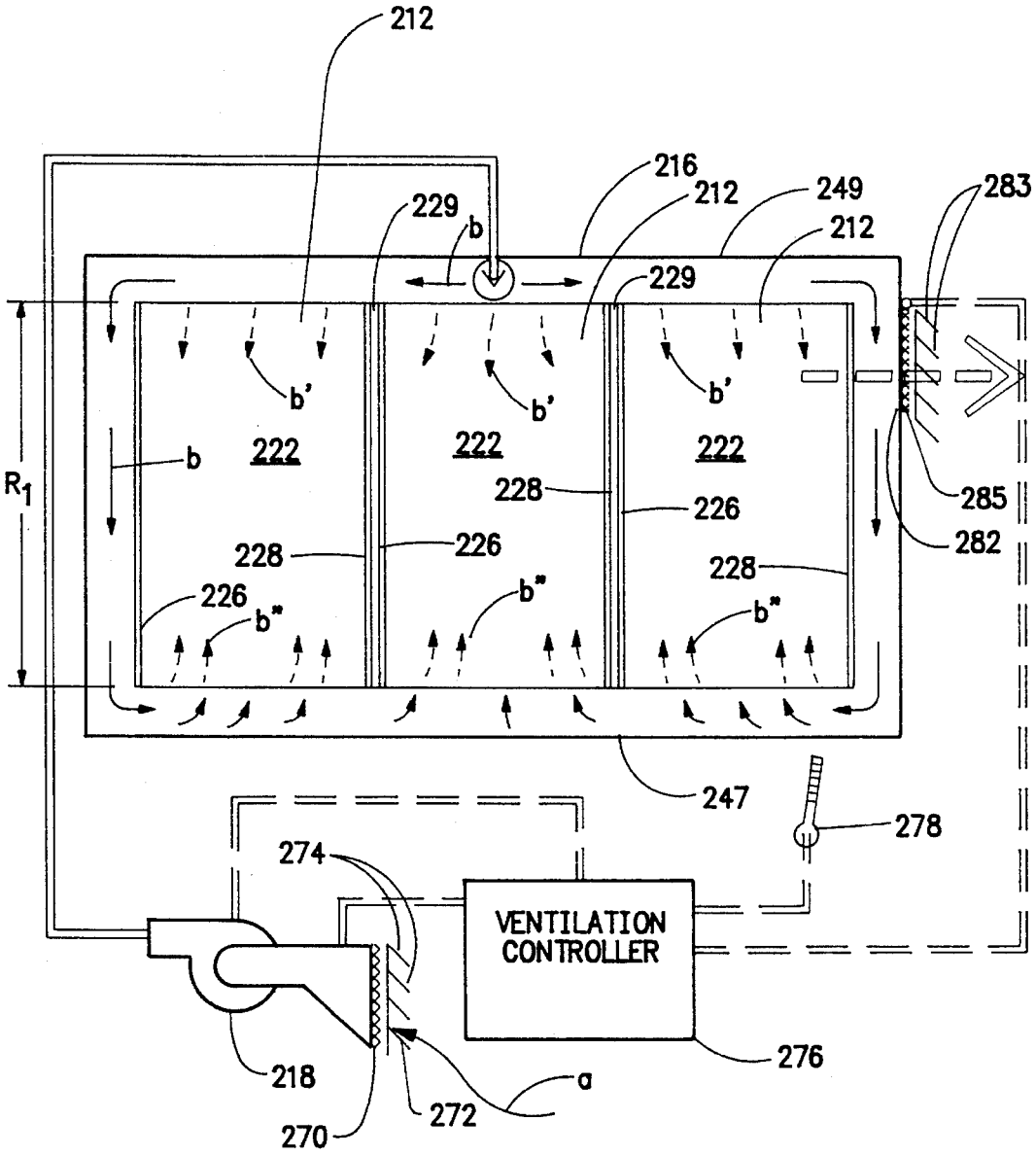
FIG. 10 is a diagrammatic illustration showing a rear view in elevation of the manifold surrounding a plurality of display panels and illustrating the operation of the ventilation system of the second exemplary embodiment of the present invention.
Figure 11:
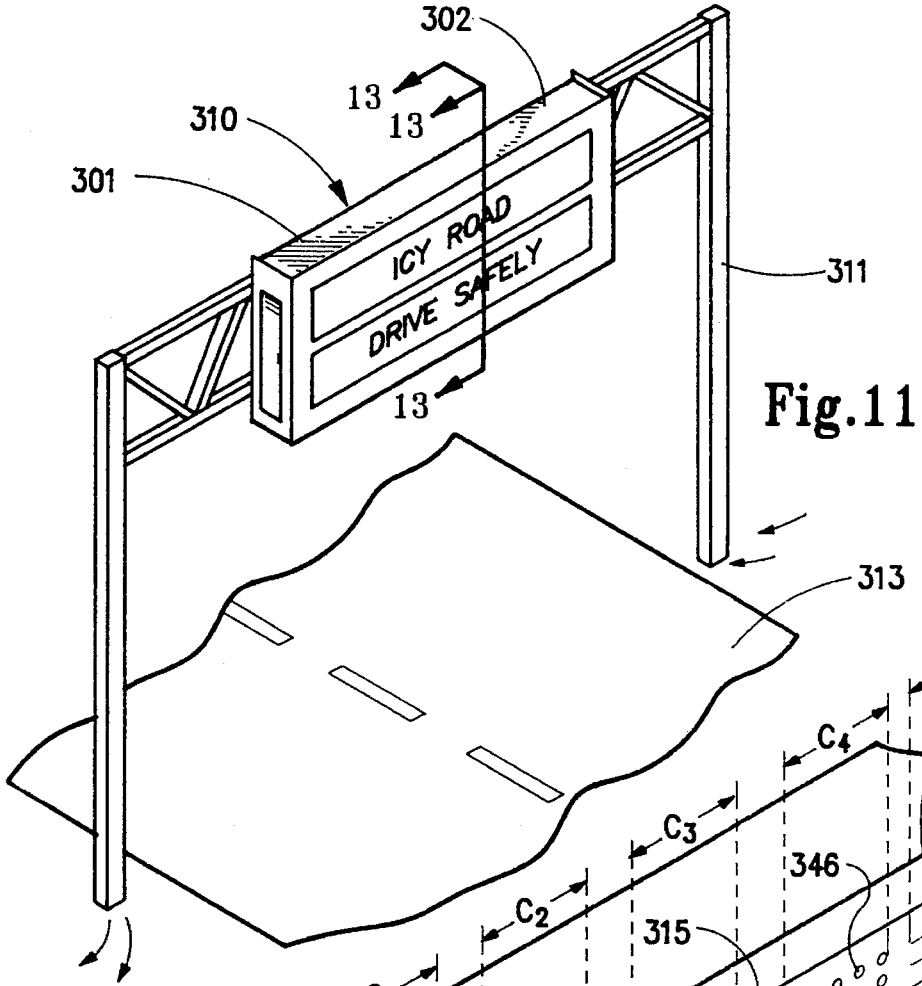
FIG. 11 is a perspective view of a third exemplary embodiment of the present invention shown mounted to a truss expanding across a roadway.

In FIGS. 9 and 10, each display panel 212 is connected between a pair of vertical brackets 226 and 228. Each of brackets 226 and 228 has opposite bracket ends 232 and 234 adapted for insertion into retainer elements 266 so that the plurality of display panels 212 can be supported therein to form row $R_1$ of display panels 212. A vertical spacer element 229 extends rearwardly relative to front panel surface 220 between adjacent vertical brackets 266 and 228 to separate adjacent ones of display panels 212. Vertical spacer elements 229 also contributes to the overall structural strength of thermally-protected display 210.

As best shown in FIG. 10, a plurality of fascia panels 284, each having a respective gasket element 292, are associated with air distributing section 247 and air balancing section 249 of manifold 216 and are positioned forwardly of cover panel structure 214. Each fascia panel 284 extends over a lateral margin portion 288 of cover panel structure 214 with a respective gasket element 292 disposed between each fascia panel 284 and each lateral margin portion 288 of cover panel structure 214. Gasket elements 292 are operative to form a seal between fascia panels 284 and cover panel structure 214. Fascia panels 284 can be adapted along a respective outer edge portion 291 to receive a mating out edge portion 293 of enclosure 202 to prevent water, dust and the like from entering into interior 204.

A pair of spacing ridges extend from each of air distributing section 247 and air balancing section 249 of manifold 216 in a forward direction relative to front panel surfaces 220 of display panels 212. The pair of spacing ridges 298 are operative to contact respective ones of fascia panels 284 therealong so as to support fascia panels 284 away from respective ones of air distributing section 247 and air balancing section 249 of manifold 216 to minimize surface to surface contact therebetween, thus, minimizing thermal conductivity therebetween.

A secondary duct 208 is in fluid communication with and between air distributing section 247 of manifold 216 and each of plenum chambers 242. Secondary duct 208 is disposed rearwardly of display panels 212 and extends laterally thereacross proximate to a lower edge portion 256 of display panels 212.

Blower mechanism 218 is disposed in interior 204 of enclosure 202. As best shown in FIGS. 9 and 10, blower mechanism 218 is in fluid communication with manifold 216. Blower mechanism 218 is operative to supply airflow "b" to manifold 216 whereby the first portion of airflow "b'" enters an air inlet 280 disposed at one end of each display panel 12 and into respective ones of plenum chambers 242. Airflow "b'" moves across display panels 212 and signal elements 224 between front panel surface 220 of each display panel 212 and cover panel structure 214 thereby dissipating heat therefrom before airflow "b'" exits each of plenum chambers 242 through an exhaust outlet 282 disposed at an opposite end of each of display panels 212. In FIG. 10, air "a" is drawn exteriorly of interior 204 and into blower mechanism 218. Airflow "b" from blower mechanism 218 first enters air balancing section 249 preferably at a medial location and then enters into air distributing section 247 before delivery to respective plenum chambers 242. Additionally, secondary duct 208 is operative to direct a first portion of airflow "b'" from blower mechanism 218 into respective ones of air inlets 280 and a second portion of airflow "b"" onto respective ones of rear panel surfaces 222 of display panels 212.

As shown in FIGS. 10, an enclosure inlet 270 includes an enclosure inlet filter 272 and motorized louvers 274 which are operative between an opened state and a closed state. A computerized ventilation controller 276 controls the operation of the ventilation system of thermally-protected display 210. A temperature sensor 278 signals ventilation controller 276 when a select first temperature is exceeded within interior 204 of enclosure 202. When ventilation controller 276 detects this signal, ventilation controller 276 activates blower mechanism 218 while simultaneously moving louvers 274 and 283 from the closed state to the opened state. Now, interior 204 is pressurized by airflow "b'" and "b"" after flowing respectively through plenum chamber 242 and onto rear panel surface 222 of display panels 212. This elevated pressure causes the airflow to exit enclosure outlet 282 through exhaust filter 285. When temperature sensor 278 signals ventilation controller 276 that a selected second temperature is achieved, ventilation controller 276 deactivates blower mechanism 278 and simultaneously moves louvers 274 and 283 from the opened state to the closed state.

Figure 12:
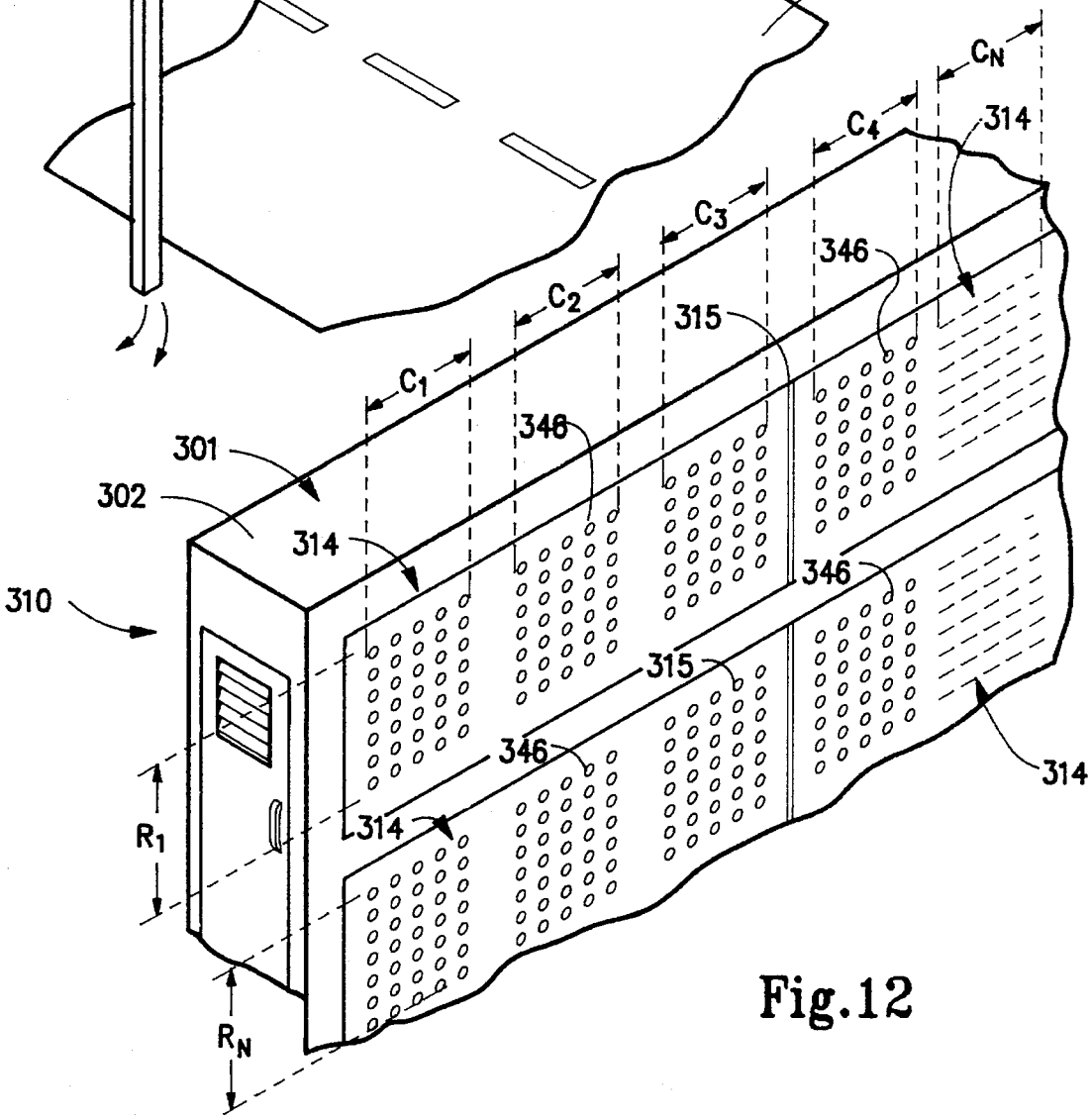
FIG. 12 is a partial, enlarged perspective view of the third exemplary embodiment of the present invention shown in FIG. 11.

A third exemplary embodiment of a thermally-protected display 310 of the present invention is illustrated in FIGS. 11–14. Thermally-protected 310 is mounted to a truss 311 expanding over a roadway 313. Thermally-protected display 310 includes a plurality of display panels 312, a plurality of cover panel structures 314, a manifold 316 and a blower mechanism 318. The plurality of display panels 312 are arranged in a series of rows $R_1$–$R_n$ and columns $C_1$ –$C_n$. At least one cover panel structure 314 is disposed in a spaced-apart relationship forwardly of a plurality of front panel surfaces 320 of display panels 312 in each row $R_1$–$R_n$ to form a plenum chamber 342 between cover panel structures 314 and each of display panels 312 in each row $R_1$–$R_n$. It is preferred that at least some of the plurality of display panel 312 are associated with a common one of cover panel structures 314. When a plurality of cover panel structures 314 are employed in a single row, a seam 315, as shown in FIG. 12, is formed between masking elements 346. Any conventional caulking compound is used to fill seam 315 to prevent rain, dust and the like from entering cover panel structures 314.

Figure 13:
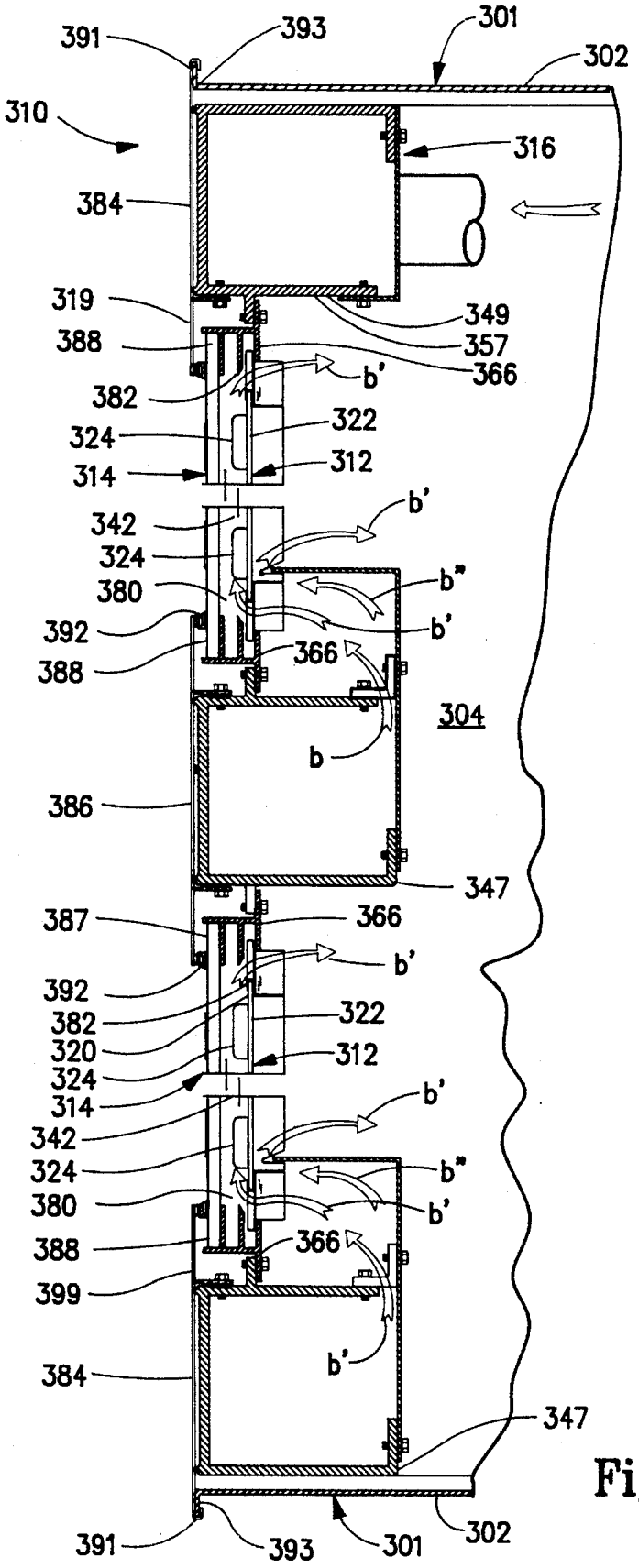
FIG. 13 is an enlarged partial side view in elevation taken along lines 13—13 in FIG. 11 showing an airflow from a manifold through a plurality of plenum chambers formed between respective cover panel structures and display panels.
Figure 14:
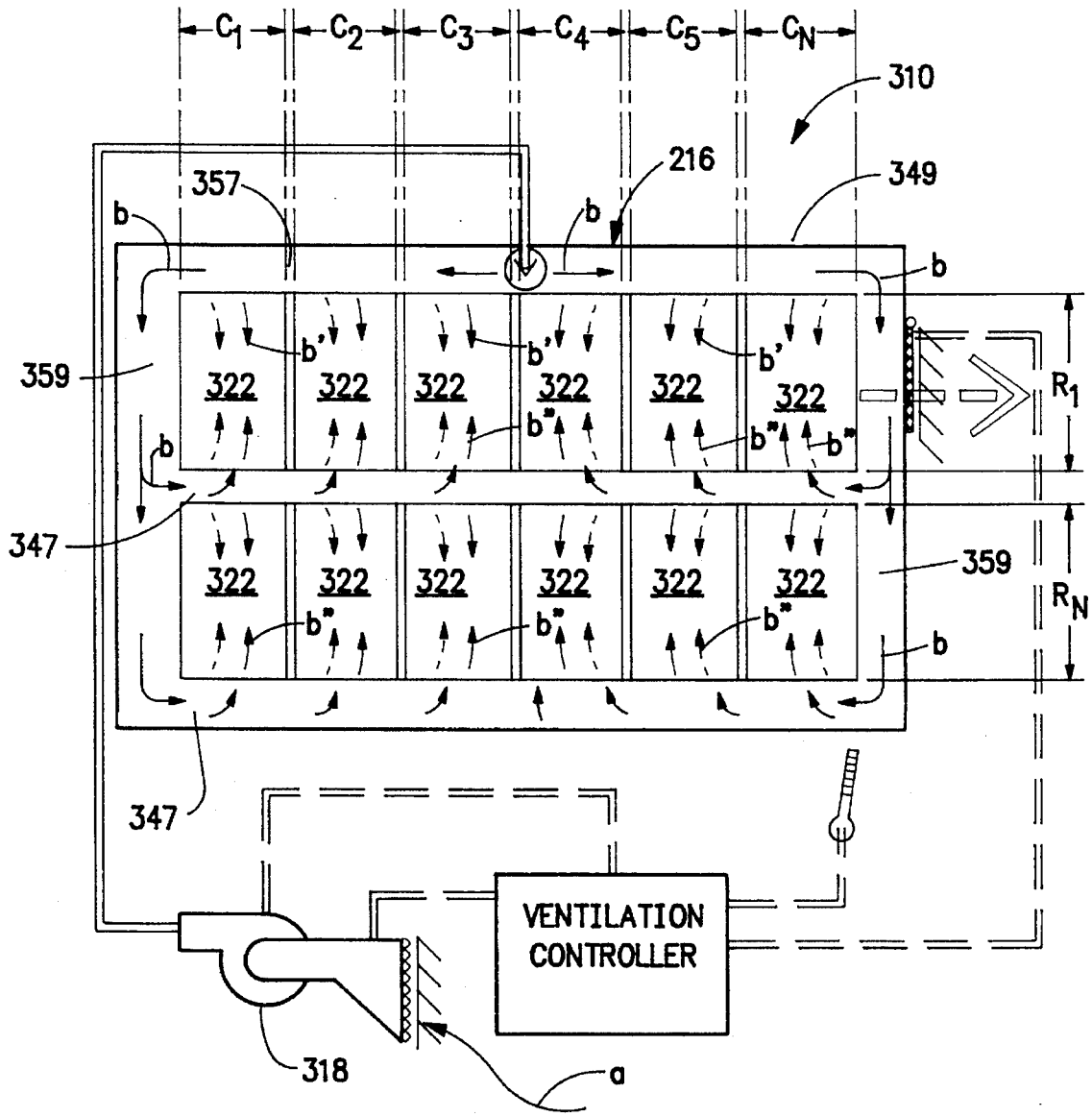
FIG. 14 is a diagrammatic illustration showing a side view in elevation of the manifold surrounding a plurality of rows and columns of display panels and illustrating the operation of the ventilation system of the third exemplary embodiment of the present invention.

As best shown in FIGS. 13 and 14, manifold 316 is associated with each row $R_1$–$R_n$ of display panels 312. Particularly, manifold 316 has a plurality of air distributing sections 347 associated with each row of display panels 312. and an air balancing section 349. Each of air distributing sections 347 is in fluid communication with a respective one of plenum chambers 342 in each row $R_1$–$R_n$ of display panels 312. Air balancing section 349 has an upper horizontal balancing portion 357 and a pair of oppositely disposed vertical balancing portions 359 which are in fluid communication with horizontal balancing portion 357 and each of air distributing sections 349 extending therebetween. The plurality of air distributing sections 347 and said air balancing section 349 are arranged to surround each row $R_1$–$R_N$ of display panels 312 and associated ones of cover panel structures 314.

In FIGS. 13 and 14, blower mechanism 318 is shown in fluid communication with manifold 316. Blower mechanism 318 is operative to supply airflow "b" to manifold 316 so that a first portion of airflow "b'" enters an air inlet 380 disposed at one end of each display panel 312 in each row $R_1$–$R_n$ and into respective ones of plenum chambers 342. Airflow "b'" moves across each of display panels 312 and signal elements 324 between respective ones of front panel surfaces 320 and cover panel structures 314 thereby dissipating heat therefrom before airflow "b"exits plenum chambers 342 through an exhaust outlet 382 disposed as an opposite end of each of display panels 312.

A housing structure 301 is operative to mount manifold 316 and display panels 312 thereby forming an enclosure 302 having an interior 304 so that rear panel surfaces 322 of rows $R_1$–$R_n$ and columns $C_1$–$C_n$ of display panels 312 face interior 304. Manifold 316 forms a frame surrounding each row $R_1$–$R_n$ of display panels 312 and associated cover panel structures 314 and is operative to be secured to enclosure 302 as described hereinabove. A pair of retainer elements 366 are associated with each row $R_1$–$R_n$ of display panels 312 and cover panel structures 315 in an opposed facing relationship. The pair of retainer elements 366 are operative to support each row $R_1$–$R_n$ of display panels 312 and associated ones of cover panel structures 314 to manifold 316.

The third exemplary embodiment of the thermally-protected display 310 of the present invention includes outer fascia panels 384 and inner fascia panels 386. Outer fascia panels 384 have an outer edge portion 391 which is adapted to a mating outer edge portion 393 of enclosure 302 and an inner edge portion 399 which is adapted to extend over lateral margin portions 388 of cover panel structures 314 with a gasket element 392 disposed between inner edge portion 399 and respective lateral margin portion 388. Inner fascia panels 386 are adapted at opposite ends to extend over respective lateral margin portions 388 of cover panel structures 314 with a gasket element 392 disposed between each opposite end and respective lateral margin portions 388.

The thermally-protected display of the present invention is designed to shield ultraviolet sunlight and other radiant energy of the sun to inhibit heat absorption. Thus, heat transfer into the interior of the enclosure can be minimized. Also, the present invention draws outside air into the interior of the enclosure to ventilate the same thereby, dissipating heat from the interior of the enclosure. Additionally, air is drawn from outside of the interior and is directed to flow across the signal elements of the display panels to also dissipate heat therefrom. The manifold used to supply the airflow to the display panels and into the interior of the enclosure also acts as a frame for mounting the display to the sign housing. Fascia panels connected to the manifold shield ultraviolet sunlight and other radiant energy which, in turn, minimizes heat transfer into the interior of the enclosure. Although the fascia panels are connected directly to the manifold, the fascia panels are disposed thereon with minimal surface to surface contact therebetween, thus minimizing thermal conductivity. The gasket element is disposed between each of the fascia panels and lateral margin portions of the cover panel structure to seal the interior of the enclosure against intrusion of air, water and other airborne particles. The cover panel structure includes a masking element that has an outer masking surface which also shields ultraviolet sunlight and, therefore, inhibits heat transfer into the interior of the enclosure. The cover panel structure has a light-transmissive panel which is approximately 90% opaque to ultraviolet sunlight which also inhibits heat transfer into the interior of the enclosure. The present invention allows easy and safe repair and maintenance of the display to be conducted within the interior of the enclosure, thus eliminating danger associated with repair and maintenance of a sign exteriorly of the display. Based on the foregoing, a skilled artisan would appreciate the significant advances of the present invention over the prior art.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. A thermally-protected display, comprising:

(a) a display panel having a front panel surface and a rear panel surface, said display panel supporting at least one signal element on said front panel surface thereof;

(b) a cover panel disposed in a spaced-apart relationship forwardly of said front panel surface of said display panel to form a plenum chamber therebetween;

(c) a manifold in fluid communication with said plenum chamber; and (d) a blower mechanism in fluid communication with said manifold and operative to supply an air flow to said plenum chamber whereby said air flow enters an air inlet disposed at one end of said display panel and into said plenum chamber so that said air flow moves across said display panel and said signal element between said front panel surface and said cover panel thereby dissipating heat from said plenum chamber before said air flow exits said plenum chamber through an exhaust outlet disposed at an opposite end of said display panel.

2. A thermally-protected display according to claim 1 wherein said manifold is operative to support said display panel and said cover panel laterally across and proximate to respective lower edge portions of said display panel and said cover panel.

3. A thermally-protected display according to claim 2 including a structural member disposed above said manifold and operative to support said display panel and said cover panel laterally across and proximate to respective upper edge portions of said display panel and said cover panel.

4. A thermally-protected display according to claim 3 including a pair of fascia panels, respectively associated with said manifold and said structural member and disposed forwardly of said cover panel, said fascia panels operative to thermally insulate said manifold and said structural member.

5. A thermally-protected display according to claim 4 wherein a respective one of said pair of fascia panels extends over opposite lateral margin portions of said cover panel and including a gasket element disposed between each fascia panel and each lateral margin portion of said cover panel, said gasket elements and operative to form a seal between respective said fascia panels and said cover panel.

6. A thermally-protected display according to claim 4 including a pair of spacing ridges extending from said manifold in a forward direction relative to said front panel surface and operative to contact said fascia panel therealong so as to support said fascia panels away from said manifold to minimize thermal conductivity therebetween.

7. A thermally-protected display according to claim 4 wherein each of said fascia panels includes an outer fascia surface having an ultraviolet protective coating operative to shield ultraviolet sunlight.

8. A thermally-protected display according to claim 7 wherein said ultraviolet protective coating is a fluropolymer resin.

9. A thermally-protected display according to claim 3 including a pair of retainer elements, each of said retainer elements mounted to a respective one of said manifold and structural member in an opposed facing relationship, said pair of retainer elements operative to support said display panel and said cover panel to and between said manifold and said structural member.

10. A thermally-protected display according to claim 9 including a plurality of display panels, each display panel connected between a pair of vertically extending brackets, each said bracket having opposite bracket ends adapted for insertion into said retainer elements so that said plurality of display panels can be supported therein to form a row of display panels.

11. A thermally-protected display according to claim 10 including a plurality of cover panels and wherein at least some of said plurality of display panels are associated with a common one of said cover panels.

12. A thermally-protected display according to claim 11 including a vertical spacer member extending rearwardly relative to said front panel surface and disposed between adjacent vertical brackets to separate adjacent ones of said display panels.

13. A thermally-protected display according to claim 12 wherein said plurality of display panels are organized into a plurality of rows and columns and including an air distributing section of said manifold associated with each row of said display panels, said air distributing sections of said manifold in fluid communication with one another by an air balancing section of said manifold.

14. A thermally-protected display according to claim 3 including a housing structure operative to mount said manifold and said display panel thereby to form an enclosure having an interior so that said rear surface of said display panel faces said interior.

15. A thermally-protected display according to claim 14 wherein said blower mechanism is disposed within said interior and is operative to draw air exteriorly thereof.

16. A thermally-protected display according to claim 15 wherein said enclosure includes an enclosure outlet operative so that said air flow exiting said plenum chamber from said exhaust outlet flows into said interior and subsequently through said enclosure outlet.

17. A thermally-protected display according to claim 1 including a secondary duct in fluid communication with and between said manifold and said plenum chamber, said secondary duct being disposed rearwardly of said display panel and extending laterally thereacross proximate to said lower edge portion of said display panel.

18. A thermally-protected display according to claim 17 wherein said secondary duct is operative to direct a first portion of said air flow into said air inlet and a second portion of said air flow onto and across said rear panel surface of said display panel.

19. A thermally-protected display according to claim 1 wherein said display panel includes an array of signal elements and wherein said cover panel includes a masking element having a plurality of windows sized and oriented so that each of said array of signal elements may be viewed through a respective window.

20. A thermally-protected display according to claim 19 wherein each of said signal elements is a cluster of light-emitting diodes.

21. A thermally-protected display according to claim 19 wherein said masking element includes an outer masking surface facing forwardly with respect to said front panel surface of said display panel and operative to thermally insulate said cover panel.

22. A thermally-protected display according to claim 21 wherein said outer masking surface is an ultraviolet protective coating operative to shield ultraviolet sunlight.

23. A thermally-protected display according to claim 22 wherein said ultraviolet protective coating is a fluropolymer resin.

24. A thermally-protected display comprising:

(a) a plurality of display panels arranged in a row, each display panel having a front panel surface and a rear panel surface and supporting at least one signal element on said front panel surface thereof;

(b) at least one cover panel structure disposed in a spaced-apart relationship forwardly of said front panel surfaces of said display panels to form a plenum chamber between said cover panel structure and each of said display panels;

(c) a manifold in fluid communication with each of said plenum chambers;

(d) a hosing structure operative to mount said manifold and each said display panel thereby to form an enclosure having an interior so that said rear surface of each said display panel faces said interior;

(e) a blower mechanism disposed in said interior of said enclosure and in fluid communication with said manifold, said blower mechanism operative to supply and air flow to said manifold whereby said air flow enters an air inlet disposed at one end of each of said display panels and into respective ones of said plenum chambers so that said air flow moves across each said display panel and said signal elements thereon between said front panel surface of each display panel and said cover panel structure thereby dissipating heat from said plenum chambers before said air flow exits each of said plenum chambers through an exhaust outlet disposed at an opposite end of each of said display panels.

25. A thermally-protected display according to claim 24 wherein said manifold forms a frame surrounding said row of display panels and operative to be secured to said enclosure.

26. A thermally-protected display according to claim 25 wherein said manifold includes at least one air distributing section in fluid communication with said row of said display panels and an air balancing section in fluid communication with said air distributing section such that said air flow from said blower mechanism first enters said air balancing section and then enters into said air distributing section for delivery to said plenum chambers.

27. A thermally-protected display according to claim 26 including a pair of retainer elements, each of said retainer elements mounted to a respective one of said air distributing section and said air balancing section of said manifold in an opposed facing relationship, said pair of retainer elements operative to support said display panels and said cover panel structure between said air distributing section and said air balancing section of said manifold and adapted to be removable into said interior.

28. A thermally-protected display according to claim 27 including a plurality of fascia panels each having a respective gasket element, said fascia panels being associated respectively with said air distributing section and said air balancing section of said manifold and positioned forwardly of said cover panel structure, and wherein each fascia panel extends over a lateral margin portion of said cover panel structure with the respective said gasket element being disposed between said fascia panel and said lateral margin portion of said cover panel structure, said gasket elements operative to form a seal between said fascia panels and said cover panel structure.

29. A thermally-protected display according to claim 28 including a pair of spacing ridges extending from each of said air distributing section and said air balancing section of said manifold in a forward direction relative to said front panel surfaces of said display panels and operative to contact respective ones of said fascia panels therealong so as to support said fascia panels away from respective ones of said air distributing section and said air balancing section of said manifold to minimize thermal conductivity therebetween.

30. A thermally-protected display according to claim 28 including a secondary duct in fluid communication with and between said air distributing section of said manifold and each of said plenum chambers, said secondary duct being disposed rearwardly of said display panels and extending laterally thereacross proximate to a lower edge portion of each of said display panels whereby said secondary duct is operative to direct a portion of said air flow into respective ones of said air inlets and a remaining portion of said air flow onto respective ones of said rear panel surfaces of said display panels.

31. A thermally-protected display, comprising:

(a) a plurality of display panels arranged in a series of rows and columns, each display panel having a front panel surface and a rear panel surface and supporting at least one signal element on said front panel surface thereof;

(b) a plurality of cover panel structures, at least one cover panel structure disposed in a spaced-apart relationship forwardly of a plurality of said front panel surfaces of said display panels in each row to form a plenum chamber between said cover panel structures and each of said display panels in each row;

(c) a manifold having a plurality of air distributing sections associated with each row of said display panels and an air balancing section, each of said air distributing sections in fluid communication with a respective one of said plenum chambers in each row of said display panels, said air balancing section having an upper horizontal balancing portion and a pair of oppositely disposed vertical balancing portions in fluid communication with said horizontal balancing portion and each of said air distributing sections extending therebetween, said plurality of air distributing sections and said air balancing section arranged to surround each row of said display panels and associated ones of said cover panel structures; and (d) a blower mechanism in fluid communication with said manifold, said blower mechanism operative to supply an air flow to said manifold whereby said air flow enters an air inlet disposed at one end of each of said display panels in each row and into respective ones of said plenum chambers so that said air flow moves across each of said display panels and said signal elements between respective ones of said front panel surfaces and said cover panel structures thereby dissipating heat from said plenum chambers before said air flow exits said plenum chambers through an exhaust outlet disposed at an opposite end of each of said display panels.

32. A thermally-protected display according to claim 31 including a housing structure operative to mount said manifold and said display panel thereby to form an enclosure having an interior so that said rear surface of said display panel faces said interior.

33. A thermally-protected display according to claim 32 wherein said manifold forms a frame surrounding each row of display panels and associated cover panel structures and operative to be secured to said enclosure.

34. A thermally-protected display according to claim 33 including a pair of retainer elements associated with each row of said display panels and said cover panel structures in an opposed facing relationship, said pair of retainer elements operative to support each row of said display panels and associated ones of said cover panel structures to said manifold, each retainer element adapted to be removable from said manifold and into said interior.

35. A thermally-protected display according to claim 31 wherein each of said display panels includes an array of signal elements and wherein each of said cover panel structures associated with a plurality of said display panels includes at least one masking element having an outer masking surface and a plurality of windows sized and arranged to correspond with said array of signal elements, said outer masking surface facing forwardly with respect to said front panel surfaces of said display panels and operative to thermally insulate associated ones of said cover panel structures.

* * * * *